United States Patent [19]

Money

[11] Patent Number: 4,568,213

[45] Date of Patent: Feb. 4, 1986

[54] FOLDABLE PEN WITH CAP

[76] Inventor: Michael Money, 85 Homestead Ave., Bridgeport, Conn. 06605

[21] Appl. No.: 690,683

[22] Filed: Jan. 11, 1985

Related U.S. Application Data

[63] Continuation-in-part of Ser. No. 450,911, Mar. 14, 1983, Pat. No. 4,508,464.

[51] Int. Cl.[4] ..... B43K 9/00; B43K 7/02; B43K 23/00

[52] U.S. Cl. ..... 401/6; 401/48; 401/202; 401/209; 401/213; 401/243

[58] Field of Search ..... 401/6, 99, 48, 202, 401/209, 213, 243

[56] References Cited

U.S. PATENT DOCUMENTS 4,508,464 4/1985 Money ..... 401/6

*Primary Examiner*—Steven A. Bratlie

[57] ABSTRACT

A pen adapted to be flat, when not being used for writing, can be used as a bookmark. The pen has three panels with one of the panels being connected to each of the other panels at opposite longitudinal edges by hinges, so that all three panels lie in the same plane when the pen is unfolded. One of the panels has a hollow reservoir for storing and dispensing ink, and a pen tip for dispensing the ink extends from the hollow reservoir. A pen tip cover extends from the panel which contains the reservoir and the outer panels are adapted with interlocking means to hold the pen in a prism shape when it is folded. The reservoir may be a three sided channel adapted to hold an ordinary pen refill. Opposite ends of the foldable pen may be flat, scalloped, triangular, pointed, or arcuate as a matter of aesthetic choice.

3 Claims, 3 Drawing Figures

FOLDABLE PEN WITH CAP

BACKGROUND OF THE INVENTION

This application is a continuation-in-part of application Ser. No. 450,911, entitled "Foldable Pen", filed on Mar. 14, 1983 now U.S. Pat. No. 4,508,464.

The present invention relates to a pen which lies flat when it is not used for writing and, thus, can be used as a bookmark. When the pen is to be used for writing, it folds into a triangular prism so that it can be easily grasped by the hand. Advantages of the foldable pen are explained in the Background of the Invention of the parent application. The original foldable pen described in the parent application, however, has some disadvantages which are overcome by the present improved version of the foldable pen. These disadvantages include the absence of means to secure the pen in its prism shape, and means to cover the pen tip when it is not being used for writing.

In addition, this application clarifies certain design changes which have been made in the original foldable pen for cosmetic reasons and contains a more accurate description as to how the pen refill is made a part of the foldable pen.

SUMMARY OF THE INVENTION

The disadvantages of the original foldable pen have been solved by the addition of a pen cap with a hinge in the region of the pen tip and fastening means which have been added to the outer panels and which snap together when the pen is folded into its prismatic shape.

In addition, the original foldable pen described a hollow reservoir for storing and dispensing ink with a pen tip such as a ballpoint tip of felt tip extending from the reservoir. While this is an accurate description of the actual pen, it is pointed out in this application that the reservoir may assume the shape of a three-sided channel on the inside of one of the folding panels.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION OF THE DRAWING

Figure 1:
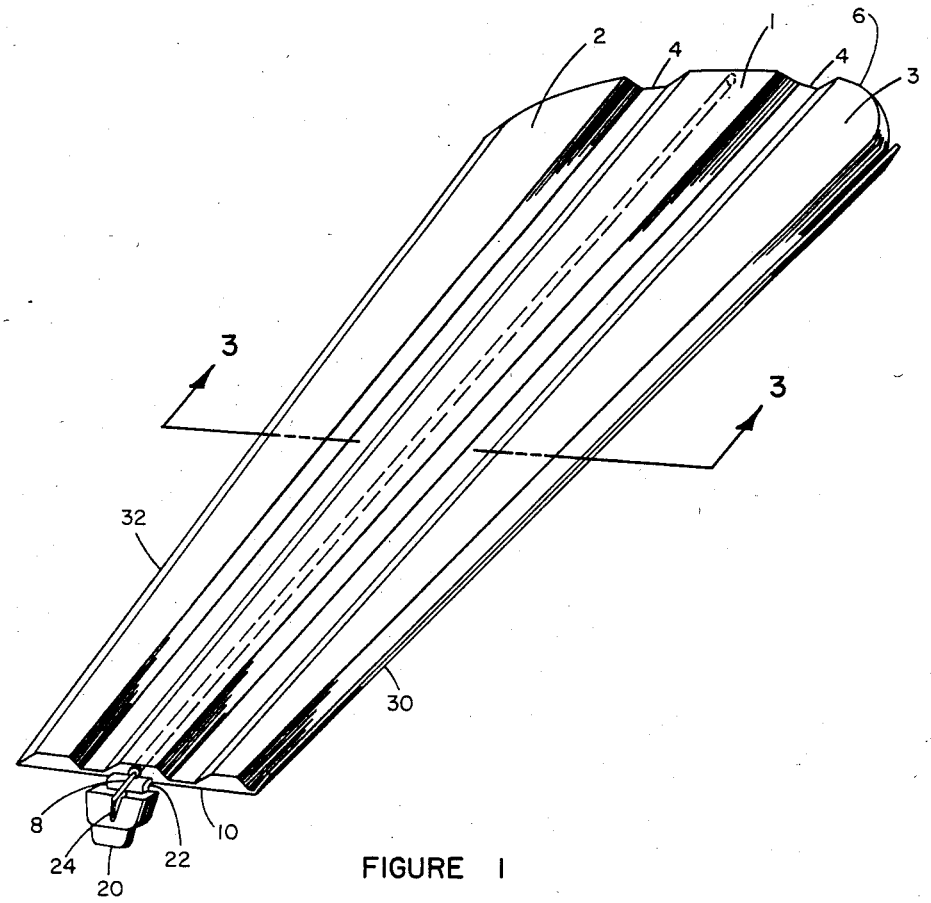
FIG. 1 is a perspective view showing the pen, when it is flat.
Figure 2:
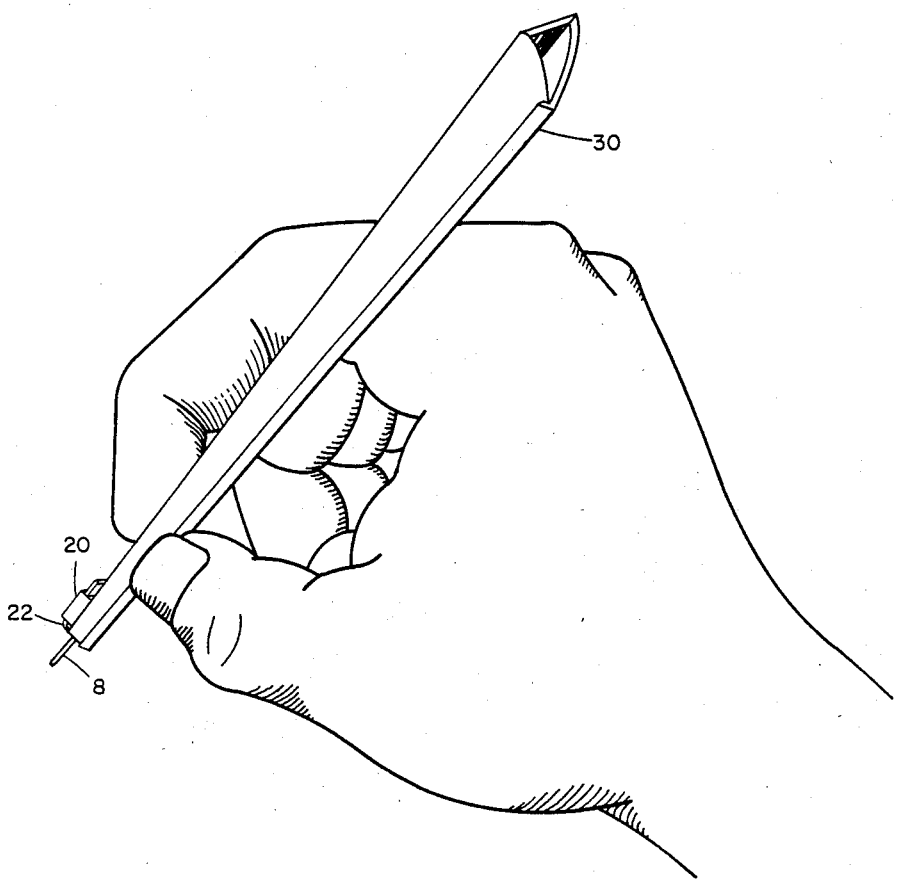
FIG. 2 is a perspective view showing the pen being grasped by a hand, ready to be used for writing.

As shown in FIG. 1, the pen comprises three panels 1, 2, and 3 which are formed most easily by injection molding of a suitable plastic such as polyethylene. The panels are formed by creating indentations 4 which act as hinges between the panels. The upper edge 6 of the panels and the lower edge 10 of the panels may be flat as shown in the parent application, scalloped, triangular, pointed, or arcuate as shown in FIG. 1 and FIG. 2. These differences in shape have no function other than aesthetic. Each of the formed panels 1, 2, and 3 are of approximately the same size and tapered at one end 5.

Figure 3:
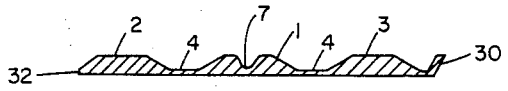
FIG. 3 is a section along plane 3—3 in FIG. 1.

One of the panels, in the drawings the center panel 1, has a hollow reservoir 7 for storing and dispensing ink. In the parent application and in FIG. 1, this reservoir 7 was shown as an enclosed cylinder within the panel, however, the reservoir 7 may assume the shape, as shown in FIG. 3 of the present application, as a three-sided channel on the surface of one of the panels. This channel is formed such that an ordinary pen refill may be more easily inserted into it than the enclosed cylinder shown in FIG. 1 and the parent application.

The pen tip 8 extends from the reservoir 7.

In the present invention, a pen tip cap 20 has been added. This cap is an integral part of the foldable pen and may be created by a minor change in the mold of the original foldable pen. The cap 20 is provided with a hinge 22 which is formed in the same manner as the hinges 4 which lie between panels 1, 2, and 3. In the center of the cap is an indentation 24. The cap is constructed of a thickness such that when it is folded over the pen tip 8 it covers the tip and prevents unwanted marking by the pen tip.

The outer edges of panels 2 and 3 are provided with clasping or snapping means 30 and 32 which hold the pen in its prism shape when writing.

These clasping means may comprise a simple extension 30 from one panel as shown in FIG. 3 which creates an interlocking with edge 32 when the pen is folded into a prism. Alternatively, the clasping means may comprise a tongue and groove type arrangement or any of a number of workable solutions. The means shown in FIG. 3 is preferred because of its simplicity of construction.

I claim:

1. An improved foldable pen comprising a substantially flat material of substantially quadrilateral shape, molded such that there are formed two longitudinal depressions in said material, said depressions defining three panels and said depressions acting as hinges between said panels, such that the pen may assume two distinct shapes, either a virtually flat substantially quadrilateral object or, when folded at its hinges, a prism; a hollow reservoir for storing and dispending ink located in one of the panels; and a pen tip extending from the reservoir for dispensing the ink;

the improvement comprising:

a foldable pen tip cover extending from the panel in which the reservoir is located.

2. An improved foldable pen comprising a substantially flat material of substantially quadrilateral shape, molded such that there are formed two longitudinal depressions in said material, said depressions defining three panels and said depressions acting as hinges between said panels, such that the pen may assume two distinct shapes, either a virtually flat substantially quadrilateral object or, when folded at its hinges, a prism; a hollow reservoir for storing and dispensing ink located in one of the panels; and a pen tip extending from the reservoir for dispensing the ink;

the improvement comprising:

the outer panels being provided with interlocking means to hold the pen in a prism shape when it is folded.

3. An improved foldable pen comprising a substantially flat material of substantially quadrilateral shape, molded such that there are formed two longitudinal depressions in said material, said depressions defining three panels and said depressions acting as hinges between said panels, such that the pen may assume two distinct shapes, either a virtually flat substantially quadrilateral object or, when folded at its hinges, a prism; a hollow reservoir for storing and dispensing ink located in one of the panels; and a pen tip extending from the reservoir for dispensing the ink;

wherein the hollow reservoir is a three sided channel which receives an ordinary pen refill.

* * * * *